US005235910A

United States Patent [19]

Tafel

[11] Patent Number: 5,235,910

[45] Date of Patent: Aug. 17, 1993

[54] BLANKET CYLINDER IMPRESSION THROW-OFF

[75] Inventor: Leonard I. Tafel, Mount Prospect, Ill.

[73] Assignee: A. B. Dick Company, Chicago, Ill.

[21] Appl. No.: 909,612

[22] Filed: Jul. 7, 1992

[51] Int. Cl.[5] ..... B41F 13/20; B41F 13/28

[52] U.S. Cl. ..... 101/218

[58] Field of Search ..... 101/217, 218, 247, 143, 101/144, 145, 137, 139, 140, 177, 182, 184, 185, 351, 352

[56] References Cited

U.S. PATENT DOCUMENTS

| | | | |
|---|---|---|---|
| 1,604,278 | 10/1926 | Goulding | 101/218 |
| 2,568,761 | 9/1951 | Peyrebrune | 101/218 |
| 2,986,086 | 5/1961 | Siebke | 101/218 |

*Primary Examiner*—J. Reed Fisher
*Attorney, Agent, or Firm*—Jones, Day, Reavis & Pogue

[57] ABSTRACT

A cylinder setting mechanism for an offset printing device in which a blanket cylinder moves eccentrically about a first pivot point to make contact with the master cylinder so that it can be inked and then subsequently moved eccentrically about a second pivot point to make contact with the impression cylinder to transfer the image to paper. The invention enables the first and second pivot points to be adjusted to compensate for wear, plate thickness, and paper stock. In addition, a stop is provided to insure that there is a predetermined contact pressure between the surfaces of the blanket cylinder and the master cylinder. The first eccentric adjustment is made by rotating an eccentric tube at only one end about a first pivot point. The blanket cylinder rotates about the outside of the eccentric tube. The second adjustment is made by rotating an eccentric shaft on which the eccentric tube is mounted to adjust the position of the blanket cylinder in relation to the impression cylinder.

25 Claims, 10 Drawing Sheets

BLANKET CYLINDER IMPRESSION THROW-OFF

FIELD OF THE INVENTION

The present invention relates in general to offset printing machines and in particular to an offset printing machine having an improved blanket cylinder throw-off which provides adjustment for plate thickness and paper thickness and reduces or minimizes wear by applying an external force in the same general direction as the impression forces to maintain the machine elements in their positions when the impression forces are cyclically removed.

BACKGROUND OF THE INVENTION

Offset printing machines are well known in the art and include a master or plate cylinder having a plate for carrying a transferable image thereon and an impression cylinder for carrying paper to receive the image. A blanket cylinder is interposed between the master cylinder and the impression cylinder such that the blanket cylinder moves eccentrically about a first pivot point to make pressure contact with the master cylinder for receiving the image and subsequently moves eccentrically about a second pivot point for making pressure contact with the impression cylinder to transfer the image to the paper. Such system is disclosed in U.S. Pat. No. 4,691,631.

Two-color offset printing machines are also known and they include a single impression cylinder, two master cylinders and two blanket cylinders. A first blanket cylinder is caused to move eccentrically about a first axis to make contact with a first master cylinder and receive the image therefrom and then move eccentrically about a second pivot point to make contact with the impression cylinder and transfer the first color to the paper on the impression cylinder. The impression cylinder then rotates and carries the image on the paper to the other pair of master and blanket cylinders where the second blanket cylinder moves eccentrically into contact with the second master cylinder to receive the second color and subsequently moves eccentrically into contact with the impression cylinder to transfer the second color to the paper. This system is also disclosed in U.S. Pat. No. 4,691,631.

In both the single and double color offset printing machines, a predetermined contact pressure must be maintained between the blanket cylinder and the master cylinder and between the blanket cylinder and the impression cylinder. Thus, the mounts for eccentrically supporting the blanket cylinder are rotationally forced against a fixed but adjustable stop which is manually adjusted in the prior art to allow a desired amount of pressure at the contact points between the master and the blanket cylinders and between the blanket and impression cylinders, respectively. Adjustment is time-consuming, but readjustment is required for wear and the like as the press is generally set up to print with a relatively fixed thickness of plates, blankets and paper stock. Adjustment, if it is required, is accomplished by varying the thickness of the packing sheet underneath the plate on the master cylinder or underneath the blanket on the blanket cylinder or by varying the center distance of the cylinders.

Small sheet-fed presses, in particular, are required to accommodate a wide range of plate and paper stock thicknesses so such semipermanent adjustments mentioned above are unusable. If the settings are to be made frequently, then they must be done simply and quickly, which is difficult, as the adjustment of the actuating means requires that the stops on each end of the cylinders must also be accurately readjusted. Because it is necessary for the eccentrics to rotate freely, thereby necessitating some clearance or springiness as in the case of bearings, if rigid stops, such as used in adjusting a web-type press, are not used to rotationally position the eccentrics, there will be a looseness which will allow the printing cylinders to bounce slightly which will be visible in the printing. Wear will obviously increase the looseness. This bouncing of the cylinders is caused by the manner in which they operate. Levers comprise part of a toggle for selectively rotating a first eccentric and an eccentric shaft such that the first eccentric moves against stops which arrest its rotation, thus providing a predetermined gap clearance between the blanket cylinder and the master cylinder and therefore providing a predetermined contact pressure. For a significant portion of the revolution of the blanket cylinder and the master cylinder, there is no impression or contact pressure due to gaps for plate and blanket lock-ups and during this time the cylinders tend to move together as there is no resisting force. The cylinders rotate around to where the printing begins again and impact occurs which tends to push the cylinders apart. They are eventually restored to their former positions after one or more reverberations. This ringing of the printing cylinders occurs and is disruptive of proper printing.

Additionally, when this occurs between, for instance, the master cylinder and the blanket cylinder, the effect will be felt at the image transfer point between the blanket cylinder and the impression cylinder. It is an effect commonly referred to as streaking or slurring. It is a particular problem when the master cylinder gap and the blanket cylinder gap do not come together the same instant as the blanket cylinder and the impression cylinders since, in this case, the effect of the gap impact occurs somewhere in the middle of the page where it is likely to be noticeable.

Although it is not possible to totally eliminate this effect, it may be minimized to an acceptable level if the blanket cylinder throw-off controls are designed to be very rigid and the forces which restrain the eccentrics are caused to be directed in essentially the same direction as the impression forces and to be substantially greater in magnitude. These forces consist of the force at the toggle that causes the first eccentric movement of the blanket cylinder and the resisting force from the stop mechanism. The vector sum of these two forces must be greater than, and directed between (i) the force vector of the contact between the master cylinder and the blanket cylinder and (ii) the force vector between the blanket cylinder and the impression cylinder. In such case, even though a certain amount of looseness is required in order that the eccentrics be free to turn, the eccentrics are pressed against their mounts in essentially the same direction as the impression pressures and any tendency for the eccentrics to move within their mounts is virtually eliminated. Thus, it is seen that the adjustment of the eccentric actuating means and the adjustment of the stop require a balancing of forces. If the stop force is too great, the toggle lever cannot be locked and, if it is too little, the eccentric actuating means will be loose and there will be a possibility of streaking and slurring of the printed image. On presses where impression pressure adjustments are seldom made, as in the web-type press, this manual adjustment can readily be accommodated. However, on presses requiring frequent changes in paper and plate thickness, protracted adjustment procedures are undesirable.

In the prior art, the structure used to overcome these problems consists of an eccentric shaft supported on both the drive and operator sides by eccentric sleeves. The sleeves coact, but are independently adjusted, and require readjustment from time to time.

The improved design herein eliminates the need for sleeve adjustment on each side and eliminates a significant part of the mechanism on the non-operator side.

In the present invention, an eccentric tube is mounted between the frame side walls of the printing mechanism and is rotated to cause the blanket cylinder to move eccentrically into and out of pressure contact with the master cylinder. An eccentric shaft is inserted within the eccentric tube and is mounted at each end in the frame's side walls and is rotated to cause the blanket cylinder to move eccentrically into and out of pressure contact with the impression cylinder. Pneumatic cylinders are connected to levers which comprise part of a toggle for selectively rotating the eccentric tube and the eccentric shaft. The eccentric tube moves against a stop which arrests its rotation, thus providing an exact gap between the blanket cylinder and the master cylinder and causing an exact impression pressure. Because the tube is eccentrically mounted on the eccentric shaft, rotation of the eccentric tube changes the position of its pivot point which changes the amount of movement of the blanket cylinder into and away from the master cylinder. In this manner, the contact pressure is adjusted as desired in a simple and efficient manner.

In addition, an eccentric cam is used for a stop means and is rotatable about its pivot point so that the amount of movement of the blanket cylinder towards and away from the impression cylinder is adjustable to maintain a constant or predetermined contact pressure in the same general direction as the impression forces.

It is a major object of the present invention to provide an offset printing machine with an eccentric tube supported by an eccentric shaft to enable independent and sequential adjustments and throw-offs for both the plate/blanket cylinders and the blanket/impression cylinders.

Thus, it is another object of the present invention to use the force from an air cylinder acting through linkages to produce a force on the eccentric tube which is in the same general direction as the resultant of the image transfer and the impression forces.

It is also an object of the present invention to use a stop arm formed as a curved extension acting on an eccentric wheel or a cam to limit the travel of the linkage and thus the relative rotary position of the eccentric tube with respect to the eccentric shaft. Such operation provides for adjustment by the operator while at the same time providing additional force to supplement that of the air cylinder to provide the "external force" to prevent rotation of the eccentric shaft within the eccentric tube.

It is a further object of the present invention to eliminate the need for eccentric sleeve adjustment on each side of the offset printing machine and simplify the adjustment mechanism on the non-operator side.

In a second embodiment, a substantially L-shaped lever is attached to the eccentric shaft for movement of the eccentric shaft to adjust the impression cylinder/-blanket cylinder contact pressure and throw-off. A teardrop shaped lever is attached in the large portion thereof to the eccentric tube member to adjust the plate cylinder/blanket cylinder contact pressure and throw-off. A triangular shaped lever is pivotally attached to the outer end of the short leg of the L-shaped lever at a first pivot point in one apex of the triangle. Another pivot point in another corner of the triangular shaped lever is superimposed over the axis of the eccentric shaft and is pivotally attached to the outer end of a piston of an air driven cylinder. The third pivot point in the third apex of the triangular shaped lever is coupled to a link that connects to a pivot point in the small outer end of the teardrop shaped link or lever coupled to the eccentric tube member. With this arrangement, adjustment of the blanket/plate cylinder pressure and throw-off can be made substantially without affecting the adjustment of the blanket/impression cylinder pressure. However, when the blanket/impression cylinder adjustment and throw-off is made, both the eccentric shaft and the eccentric tube move in unison.

In still another embodiment, a lever is secured to the eccentric shaft and has three pivot points spaced with respect to each other to form an acute triangle. Again, a teardrop shaped lever is coupled at its large end to the eccentric tube member. A first link has one end pivotally coupled to the small outer end of the teardrop shaped lever and the other link has one end coupled to the upper pivot point of the lever coupled to the eccentric shaft. The other ends of both of the links are pivotally coupled to the outer end of the piston of a first air cylinder such that movement of the air cylinder piston moves both the eccentric shaft and the eccentric tube member simultaneously. One of the lower pivot points of the lever coupled to the eccentric shaft is attached through a linkage to the outer end of a second air cylinder driven piston such that rotation of the eccentric shaft by the second air cylinder does not substantially affect the position of the teardrop shaped lever coupled to the eccentric tube member. Incremental adjustments are available for adjusting both the impression cylinder and the plate cylinder pressure contacts with the blanket cylinder.

SUMMARY OF THE INVENTION

Thus, the present invention relates to an offset printing machine comprising laterally spaced vertical frame side walls, a fixed master cylinder rotatably mounted between the walls for carrying a transferable image thereon, a fixed impression cylinder rotatably mounted between the walls for carrying paper thereon to receive the image, an eccentric shaft rotatably mounted between the walls for movement about a first pivot point, an eccentric tube member rotatably mounted on the shaft for movement about a second pivot point, and a blanket cylinder rotatably mounted on the eccentric tube member such that rotation of the eccentric tube member about the second pivot point causes a predetermined pressure contact of the blanket cylinder with the master cylinder for receiving the image, and rotation of the eccentric shaft about the first pivot point causes a variation in the pressure contact of the blanket cylinder with the impression cylinder to transfer the image to the paper.

The invention also relates to an offset printing machine in which the vector forces for moving a blanket cylinder about a first pivot point to cause a contact pressure between the blanket cylinder and a master cylinder and the vector force caused by a rigid stop are such that the vector sum of those forces lies between and is greater than the contact pressure force vector between the blanket cylinder and the master cylinder and the contact pressure force vector between the blanket cylinder and the impression cylinder, thereby tending to maintain a desired contact pressure between the blanket cylinder and the master cylinder and between the blanket cylinder and the impression cylinder and to minimize bouncing of the cylinders with respect to each other.

The invention also relates to an offset printing machine comprising laterally spaced vertical frame side walls, a fixed master cylinder rotatably mounted between the walls for carrying a transferable image thereon, a fixed impression cylinder rotatably mounted between the walls for carrying paper thereon for receiving the image, a blanket cylinder rotatably mounted between the walls for first eccentric movement about a first pivot point to make pressure contact with the master cylinder for receiving the image and for subsequent second eccentric movement about a second pivot point for making pressure contact with the impression cylinder to transfer the image to the paper, an eccentric tube mounted between the walls for rotation about the first pivot point to cause the first eccentric movement of the blanket cylinder, first toggle means coupled to the eccentric tube for independently and selectively rotating the tube about the first pivot point with a force represented by a first force vector to cause the first eccentric movement of the blanket cylinder and provide a predetermined spacing for a desired pressure contact between the blanket cylinder and the master cylinder as represented by a second force vector, a shaft eccentrically mounted within the eccentric tube and at its ends in the spaced side walls for rotation about the second pivot point to cause the second eccentric movement of the blanket cylinder, second toggle means coupled to the eccentrically mounted shaft for independently and selectively rotating the shaft about the second pivot point to cause the second eccentric movement of the blanket cylinder and provide a predetermined pressure contact between the blanket cylinder and the impression cylinder as represented by a third force vector, and a stop arm associated with the eccentric tube for limiting rotation of the tube about the first pivot point and generating a fourth force vector, the fourth force vector being applied in substantially the same direction as the third force vector thereby tending to maintain a desired contact pressure between the blanket cylinder and master cylinder and between the blanket cylinder and the impression cylinder when the impression forces are removed.

BRIEF DESCRIPTION OF THE DRAWINGS

These and other objects of the present invention will be more clearly understood in conjunction with the following detailed description taken in conjunction with the accompanying drawings in which like numerals represent like elements and in which.

DETAILED DESCRIPTION OF THE DRAWINGS

As set forth in commonly assigned co-pending application Ser. No. 575,034, filed Aug. 30, 1990, entitled "Offset Printing Machine", which is incorporated herein by reference in its entirety, offset printing machines are well known in the art. In those systems, paper sheets from a paper stack are picked in any well-known manner such as by sucker tubes and are conveyed to a paper feed conveyer and a transfer cylinder. The paper stops and registers and then the transfer cylinder grips the paper and transfers it to the impression cylinder that also has grippers thereon to pick up the sheets. A system for transferring ink to apply the image to the sheet includes an offset blanket cylinder and master cylinder. At the beginning of the operation of the machine, the system requires that the image transmitting surfaces on the blanket cylinder be suitably inked in order to print an acceptable image on the initial sheet of paper on the impression cylinder as the sheet of paper passes through the machine. Accordingly, before the blanket cylinder contacts the sheet of paper on the impression cylinder, it is desirable that it be inked. Thus, the surface of the blanket cylinder is brought into contact with the surface of the master cylinder. Once the surface of the blanket cylinder is inked, it is brought into contact successively with the sheet of paper on the impression cylinder. The sheet of paper then passes through a delivery cylinder to the receiving stack.

It is well known that the master cylinder has a cylinder clamp in a gap to mount the plate on the master cylinder. In addition, the blanket cylinder also has a gap for carrying a clamp to hold the blanket on the cylinder. Each of these gaps is always lower than the surface of the cylinder itself. Thus, each time the gap encounters the adjacent cylinder, no force is applied between the cylinders. When the gap on the impression cylinder is adjacent to the gap on the blanket cylinder, there is no contact between the blanket and the impression cylinder. Thus, during the gap event between the impression cylinder and the blanket cylinder, which is for a duration of 60°, there is a cylinder loading pressure between the master cylinder and the corresponding blanket cylinder. In like manner, during correspondence of the gaps between the master cylinder and the blanket cylinder, there is a cylinder loading pressure between the impression cylinder and the blanket cylinder. Thus, for a duration of 60°, there is a pressure load between the impression cylinder and the blanket cylinder and for another 60° there is a pressure load between the master cylinder and the blanket cylinder. For the remainder of the cycle, there is a pressure load occurring between both the impression cylinder and the blanket cylinder and between the master cylinder and the blanket cylinder.

Figure 1A:
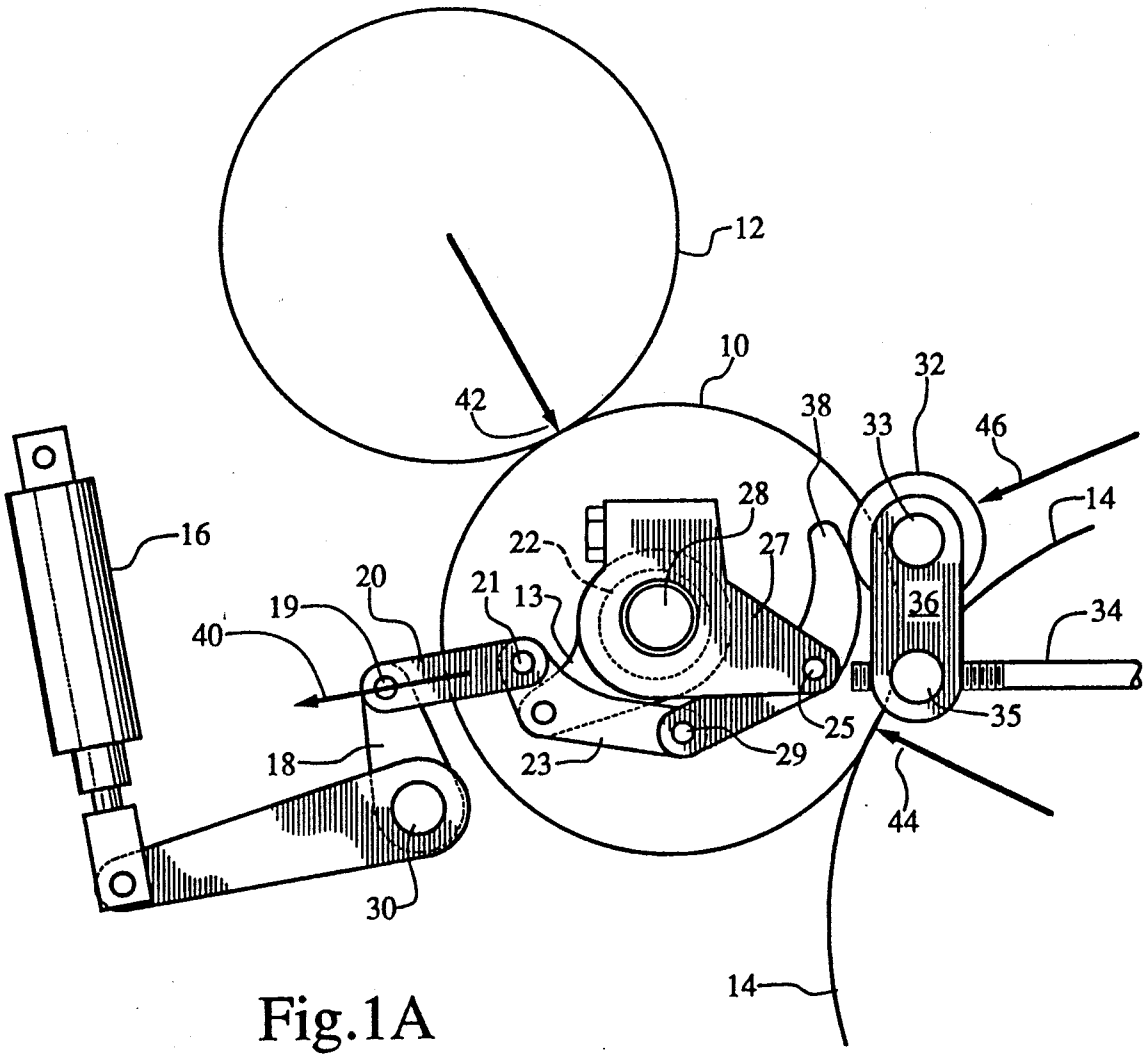
FIGS. 1A and 1B are detailed end view drawings of the offset printing machine on the inside and the outside of the machine frame wall illustrating the adjustment mechanism for both the first pivot point for the blanket cylinder/master cylinder adjustment and the second pivot point for the blanket cylinder/ impression cylinder adjustment.

FIG. 1A is a diagrammatic representation of the mechanism utilized in the present invention to bring the blanket cylinder 10 into and out of correspondence with the master or plate cylinder 12 and the impression cylinder 14. It is an end view of the mechanism on the inside of frame wall 50 taken along lines 1A—1A of FIG. 2. Thus, when air cylinder 16 moves first toggle lever 18 counterclockwise in FIG. 1, it causes linkage 20 to move an eccentric tube 22 in a counterclockwise direction about its pivot point on the center line $CL_1$ of tube 22 (see FIG. 2) to move the blanket cylinder 10 into contact with the master cylinder 12 so that the blanket cylinder 10 may be inked.

Figure 1B:
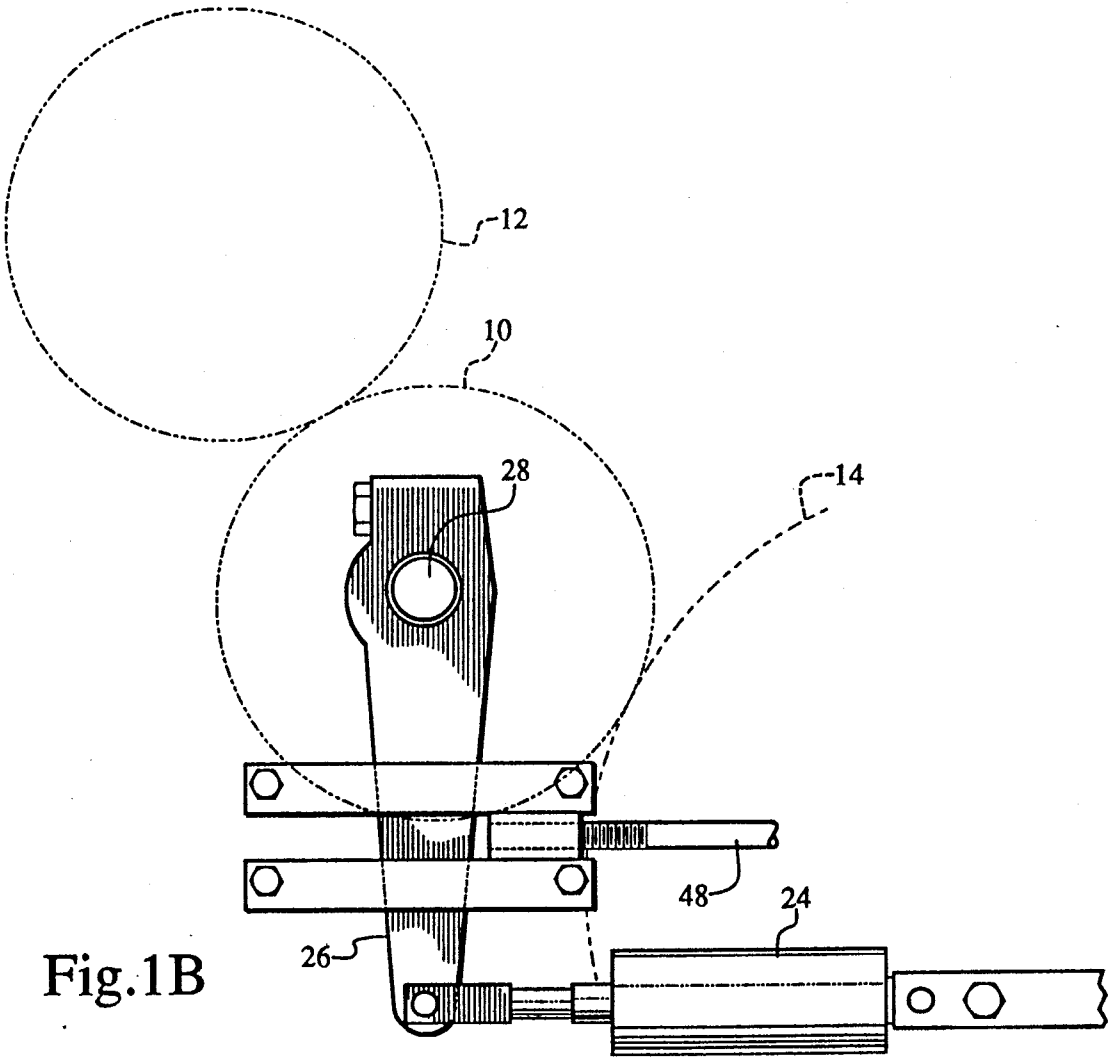
Figure 2:
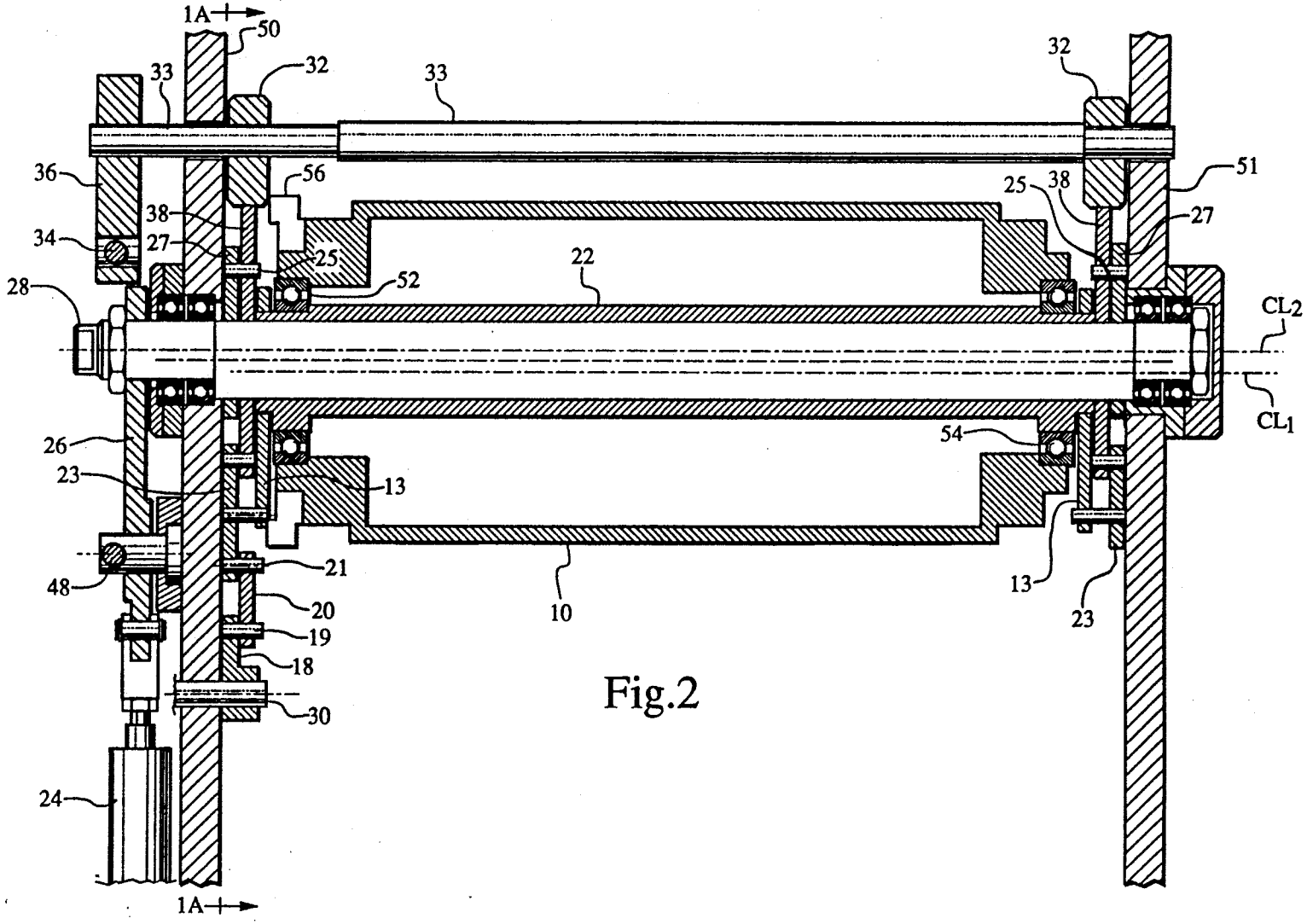
FIG. 2 is a cross-sectional view of the blanket cylinder mounted on the eccentric tube which is eccentrically mounted on the eccentric shaft, the ends of which are mounted in the vertical frame walls of the machine.

As shown in FIG. 1B, an end view of the mechanism on the outside of frame 50 in FIG. 2, when the blanket cylinder 10 has been inked, a second air cylinder 24 moves a second toggle lever 26 to rotate an eccentric shaft 28 clockwise about its pivot point on the center line $CL_2$ of shaft 28 (see FIG. 2) to cause the blanket cylinder 10 to move into contact with the impression cylinder 14 for receiving the image.

Thus, the eccentric shaft 28 supports an eccentric tube 22 to provide independent and sequential adjustment to and throw-offs for the blanket cylinder 10 with respect to both the master or plate cylinder 12 and the impression cylinder 14. Also, it is clear that the linkages moving the eccentric shaft 28 and the eccentric tube 22 could be reversed. That is, the linkage driving eccentric shaft 28 could be used to drive the eccentric tube 22 with the converse being true.

Clearly, a predetermined amount of contact pressure is desired between the blanket cylinder 10 and master cylinder 12 and the impression cylinder 14. Adjustment, however, must be made for normal wear, thickness of plates, thickness of blankets and paper stock used. A first mechanism is used to adjust the amount of eccentric movement of the blanket cylinder 10 about the pivot point on center line $CL_1$ toward or away from the master cylinder 12. The position of eccentrically mounted wheel or cam 32 is adjusted by rotating the threaded rod 34 inside cross-drilled and threaded cylindrical shaft 35, thus causing lever 36 in FIG. 1A to rotate about shaft 33 to move linkage 36 which moves eccentric wheel or cam 32. Clearly, as the eccentric cam 32 is moved, more of the eccentric portion of cam 32 will extend towards a stop arm 38 formed as a curved extension that is attached to linkage 23. When air cylinder 16 moves linkage 18 clockwise about impression throw-off shaft 30, the stop arm 38 moves counterclockwise about the axis of the eccentric tube, thus moving the blanket cylinder 10 closer to the plate cylinder 12. The movement stops when curved stop arm 38 contacts the eccentric cam or wheel 32. It will be seen that the more eccentric cam 32 is moved counterclockwise by linkage 36, the sooner the cam 32 will contact the curved stop arm 38, thus preventing any further movement of blanket cylinder 10 towards plate cylinder 12. The force from air cylinder 16 acting through linkages 18 and 20 will then produce a force 40 on the eccentric tube 22 which is in the same general direction as the impression forces 44. Since wearing of the components can adversely affect the printing, the structure disclosed in FIG. 1A can prevent or minimize the adverse affects by applying the external forces 44, 46 and 40 in the same general direction as the impression forces, thus maintaining the machine elements in their positions when the impression forces are removed. A rod 48, by moving horizontally in FIG. 1B, will contact linkage 26 and make corresponding adjustments to the eccentric shaft 28 to adjust its position in relation to the impression cylinder 14.

FIG. 2 is a cross-sectional end view of the offset printing machine shown in FIGS. 1A and 1B. As can be seen in FIG. 2, the plate impression throw-off shaft 30 is coupled to operator side wall 50 of the printing machine. The toggle link 18 is coupled to the shaft 30 and is also coupled to link 20 by pin 19. Link 20 is coupled with pin 21 to link 23. Pin 29 couples link 23 to the curved stop arm 38 which contacts the eccentric cam 32. Eccentric cam 32 is adjusted as explained previously through link 36 which is moved by rod 34. It will be noted that link 27 is attached to the eccentric tube 22 and to stop arm 38 with pin 25 to rotate eccentric tube 22 about its pivot point. The blanket cylinder 10 rotates on the outer surface of the eccentric tube 22 on bearings 52 and 54. The blanket cylinder 10 is rotated in a conventional manner through a ring gear 56. Eccentric shaft 28 is rigidly coupled to link 26 which is moved by air cylinder 24 as described previously. By adjusting rod 48 and its associated linkage, arm 26 is moved to adjust the pivot point of eccentric shaft 28.

Figure 3:
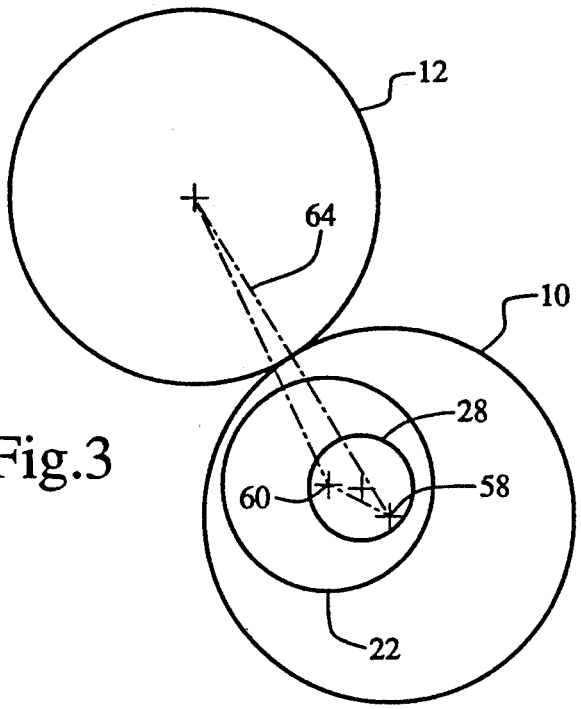
FIG. 3 is an illustration of the manner in which adjustment of the eccentric tube adjusts the eccentric movement of the blanket cylinder toward and away from the master cylinder.

The diagrammatic representation of the operation of the blanket cylinder 10 with respect to the plate cylinder 12 is illustrated in FIG. 3. As can be seen in FIG. 3, as the eccentric tube 22 is rotated about its pivot point 60 in a counterclockwise direction, the distance 64 separating the centers of the blanket cylinder 10 from the plate cylinder 12 becomes shorter, thus indicating a movement of the blanket cylinder 10 towards the plate cylinder 12. In like manner, if the eccentric tube 22 is rotated clockwise in FIG. 3, the center point 58 of the blanket cylinder 10 is moved further away from plate cylinder 12, thus indicating that the blanket cylinder 10 is moving away from plate cylinder 12.

Figure 4:
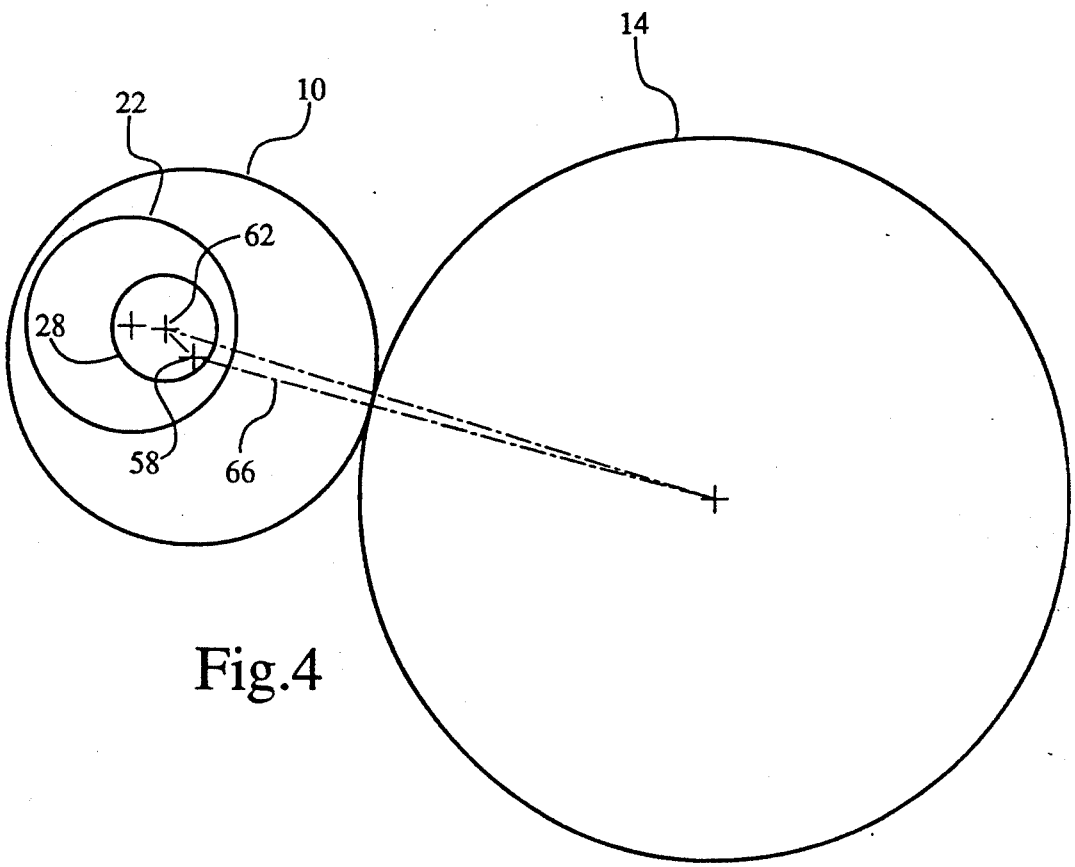
FIG. 4 is an illustration of the manner in which adjustment of the eccentric shaft adjusts movement of the blanket cylinder toward and away from the impression cylinder.

FIG. 4 is a diagrammatic representation of the operation of the eccentric shaft 28 in causing the blanket cylinder 10 to move towards or away from the impression cylinder 14. As can be seen in FIG. 4, if the eccentric shaft 28 is rotated clockwise about its pivot point 62, the center axis 58 of the blanket cylinder 10 moves clockwise and the distance from the central point 58 of the blanket cylinder 10 and the impression cylinder 14 becomes longer, as indicated by the line 66, and thus the blanket cylinder 10 moves away from impression cylinder 14. However, if the eccentric shaft 28 is moved counterclockwise about its pivot point 62, then the center axis 58 of the blanket cylinder 10 moves closer to the impression cylinder 14 as indicated by line 66, thus bringing the blanket cylinder 10 closer to the impression cylinder 14. Clearly, in FIG. 4 by rotating the eccentric shaft 28 about its pivot point 62, the blanket cylinder 10 can be adjusted to move towards or away from impression cylinder 14, thus making adjustment possible for variation in blanket thickness and any wear in the parts. In like manner, in FIG. 3, rotation of the hollow tube 22 about its pivot point 62 will likewise adjust the position of the blanket cylinder 10 with respect to the plate cylinder 12.

It will be noted that eccentric tube 22 is driven or rotated at only one end. Further, the eccentric shaft 28 is also rotated at only one end. A stop wheel or cam 32 is shown on both sides of the frame for accuracy in stopping the rotation of the eccentric tube 22.

Figure 5C:
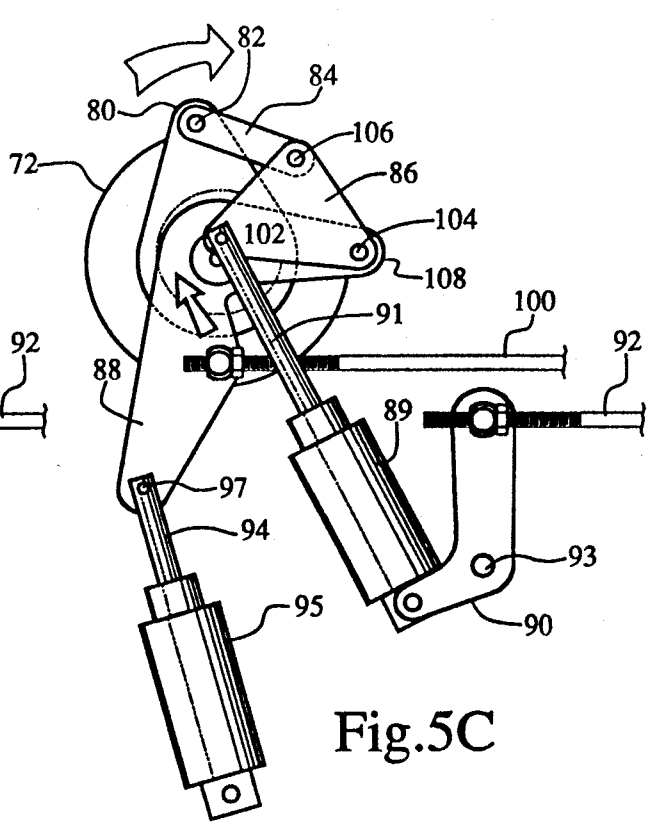
FIGS. 5A, 5B and 5C are end versions of a second embodiment of the present invention in which the position of a first air cylinder piston for the impression cylinder that is coupled to the eccentric shaft is held constant while a second air cylinder for adjusting the blanket-to-plate cylinder adjustment is moved and illustrating a triangular linkage in three different positions as the second air cylinder moves.
Figure 5B:
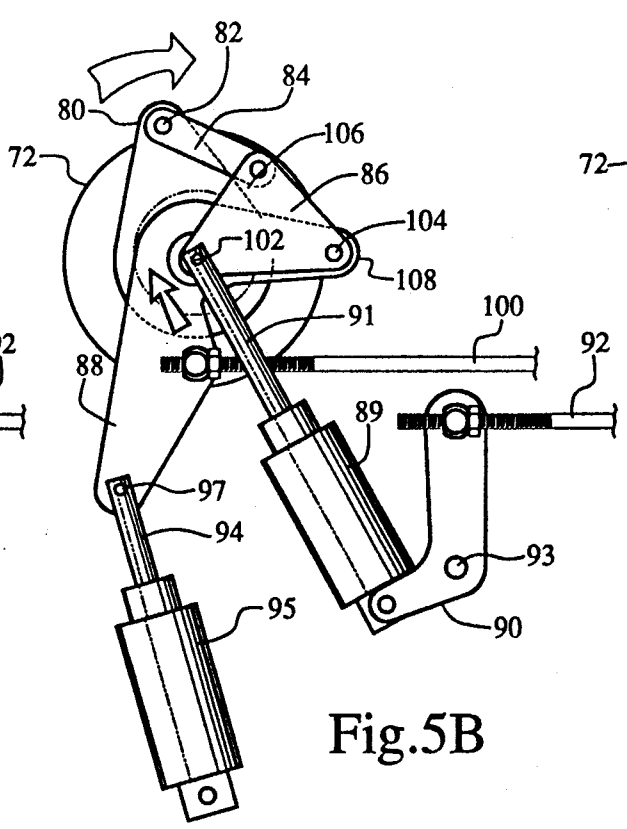
Figure 5A:
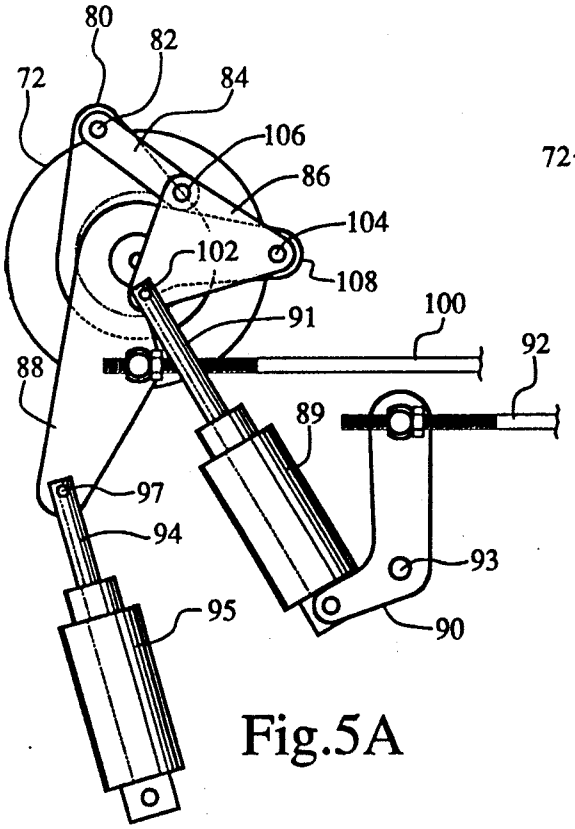

FIGS. 5A, 5B and 5C illustrate the end views of an alternate embodiment of the present invention which utilizes a triangular shaped linkage to control the adjustment of the eccentric shaft and eccentric tube simultaneously for the blanket-cylinder-to-plate-cylinder adjustment and throw-off and illustrating the triangular plate in three different positions as the first air cylinder 89 for the blanket cylinder adjustment is moved while the second air cylinder 95 for the impression/blanket cylinder throw-off is held fixed. Note, in FIG. 5A, that a generally L-shaped lever 88 is attached to eccentric shaft 78 for rotating the same. A teardrop shaped lever 80 has substantially the center of the large end thereof pivotally attached to the eccentric tube member 76 for rotation thereof. A triangular shaped plate lever 86 has three orifices in the corners thereof: orifice 102 is pivotally coupled to the outer end of piston 91 of first air cylinder 89; orifice 104 is coupled to an orifice in the outer end 108 of the short leg of the L-shaped lever 88; and orifice 106 is pivotally coupled by a link 84 to an orifice 82 in the small outer end of the teardrop shaped lever 80. The blanket cylinder 72 is rotatably mounted on bearings 74 (shown in FIG. 7) that are on eccentric tube member 76. A second air cylinder 95 has the outer end of its piston 94 attached at pivot point 97 to the outer end of the longest leg of the L-shaped lever 88. Note, in FIG. 5A, that the pivot point 102 of the triangular shaped plate 86 is in superimposed relationship above the rotatable axis of the eccentric shaft 78. Placing the pivot 102 of the triangular plate linkage 86 (which rotates the eccentric tube 76 that controls the blanket-to-plate printing pressure) over the exact center of the pivot of eccentric shaft 78 (for the impression-cylinder-to-blanket-cylinder adjustment and throw-off) effectively eliminates interaction between the two adjustments when air cylinder 89 is causing blanket cylinder throw-off. However, when cylinder 95 is moving the L-shaped lever 88 to affect the impression cylinder throw-off, movement of the outer end 108 of the L-shaped lever 88 also moves triangular plate 86 which affects the adjustment of the eccentric tube member 76, thus causing the eccentric shaft 78 and the eccentric tube member 76 to move in unison. The impression cylinder/blanket cylinder gap or pressure adjustment can be made with rod 100 having a nut 98 thereon and associated with stop 96 on the L-shaped lever 88. By changing the point at which nut 98 engages stop 96, the impression cylinder/blanket cylinder pressure or gap can be adjusted by providing a stop point.

In like manner, a link 90 pivotally couples the outer end of air cylinder 89 to an adjustment rod 92. By threadedly attaching the adjusting rod 92 to the outer end 101 of link 90, the link 90 can be moved around its pivot 93, thus changing the position of air cylinder 89 and affecting the blanket cylinder/plate cylinder gap and throw-off adjustment. FIGS. 5B and C show different positions of the triangular shaped plate lever or link 86 to illustrate how it affects both the adjustment of the eccentric shaft 78 and the eccentric tube member 76 as it moves.

Figure 6C:
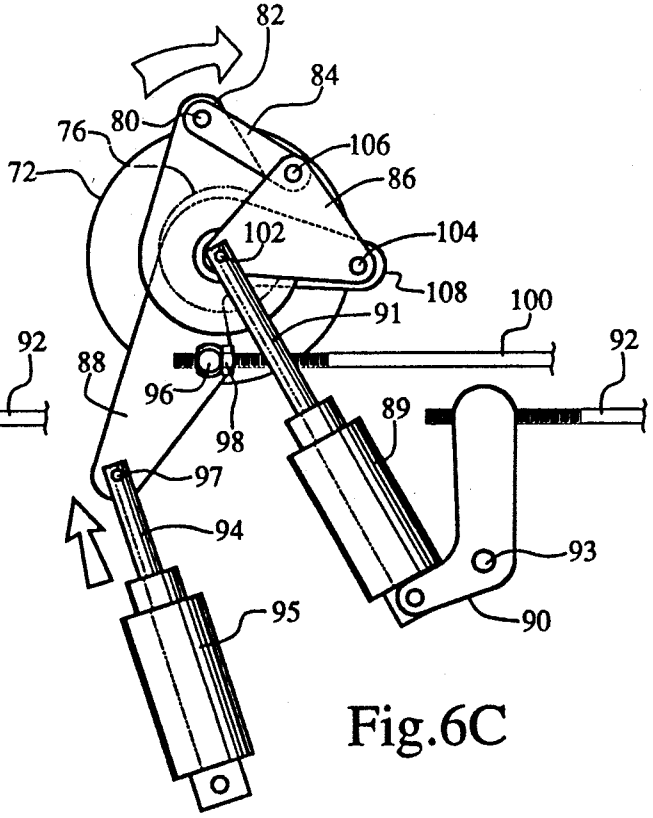
FIGS. 6A, 6B and 6C are end views of the device illustrated in FIG. 5 in which the first air cylinder making the blanket-to-plate cylinder adjustment is held constant and the second air cylinder moving the L-shaped link coupled to the eccentric shaft is shown in three different positions.
Figure 6B:
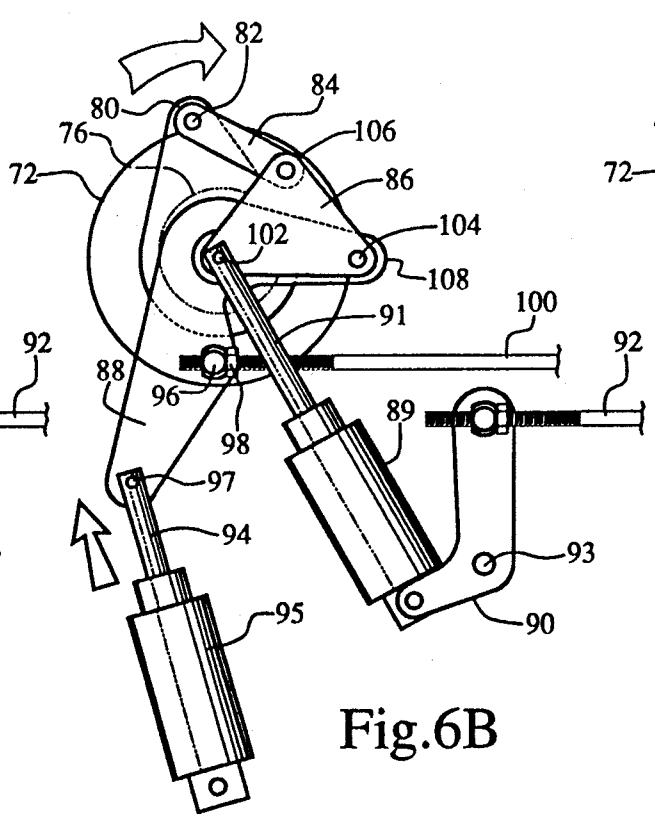
Figure 6A:
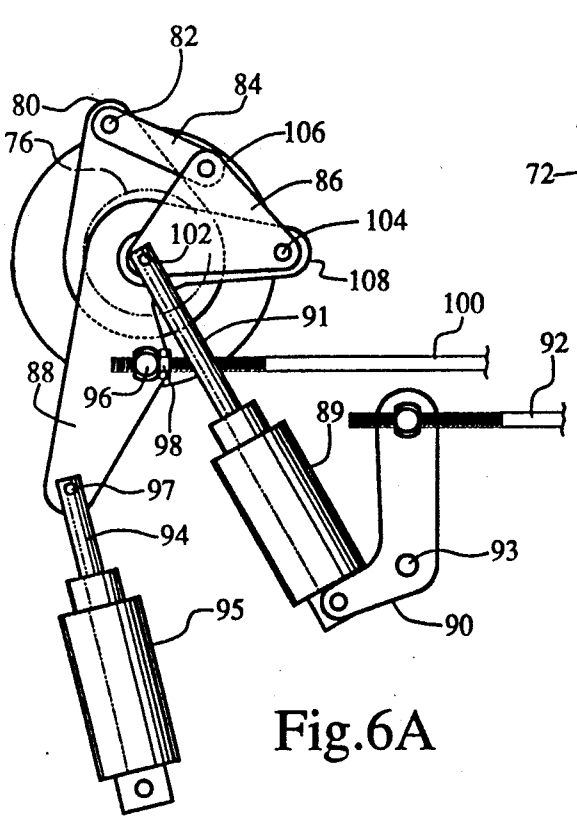

FIGS. 6A, B and C are similar to FIGS. 5A, B and C except that, in FIG. 6, the first air cylinder 89 is held in a fixed position while the second air cylinder 95 moves to three different positions illustrating how a movement of the L-shaped link 88 enables the eccentric shaft 78 to be adjusted while simultaneously moving the eccentric tube member 76 in unison with the eccentric shaft 78.

Figure 7:
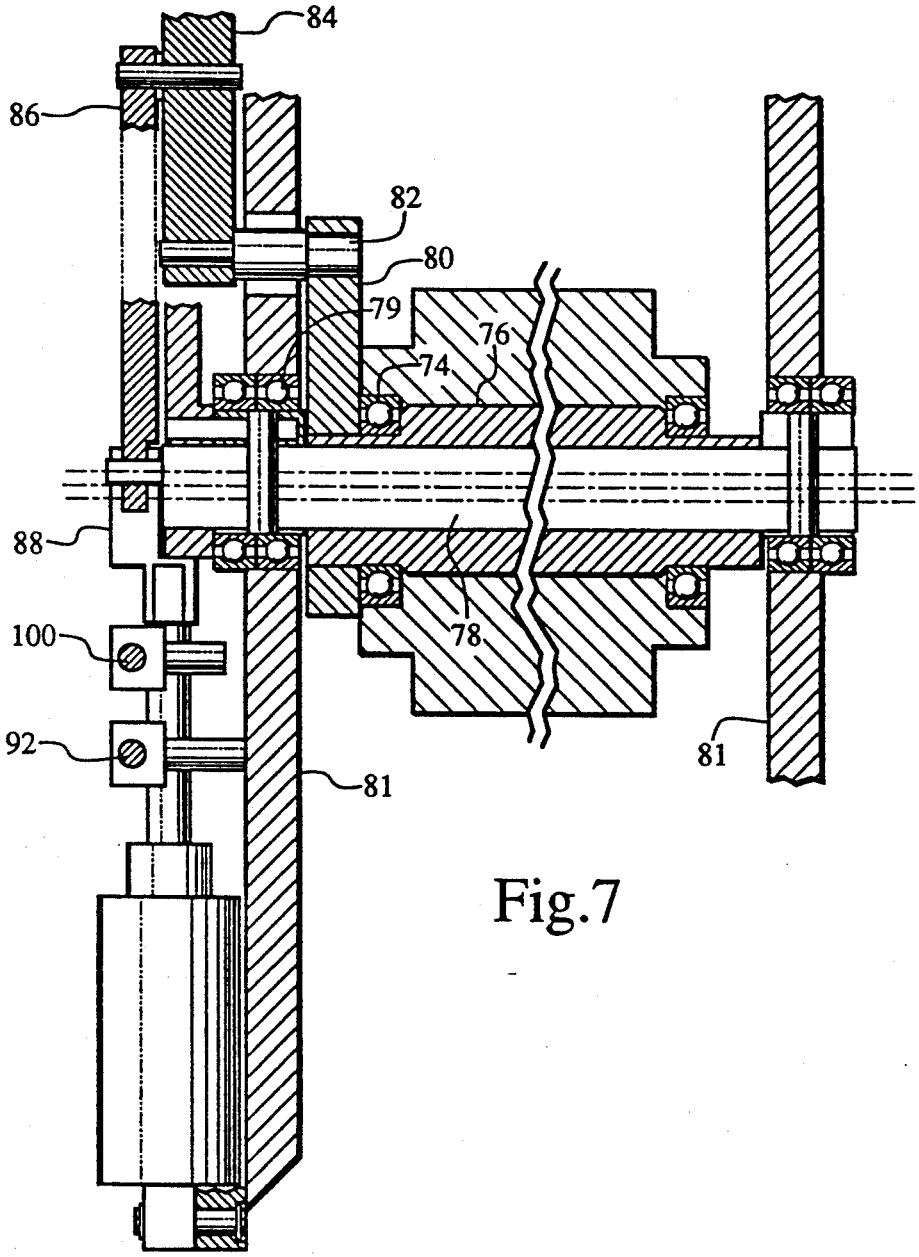
FIG. 7 is a partial cross-sectional view of an offset printing machine incorporating the embodiment illustrated in FIGS. 5 and 6.

FIG. 7 is a partial cross-sectional view of the offset printing machine to illustrate the features of the device shown in FIGS. 5 and 6.

Figures 8A, 8B, 8C:
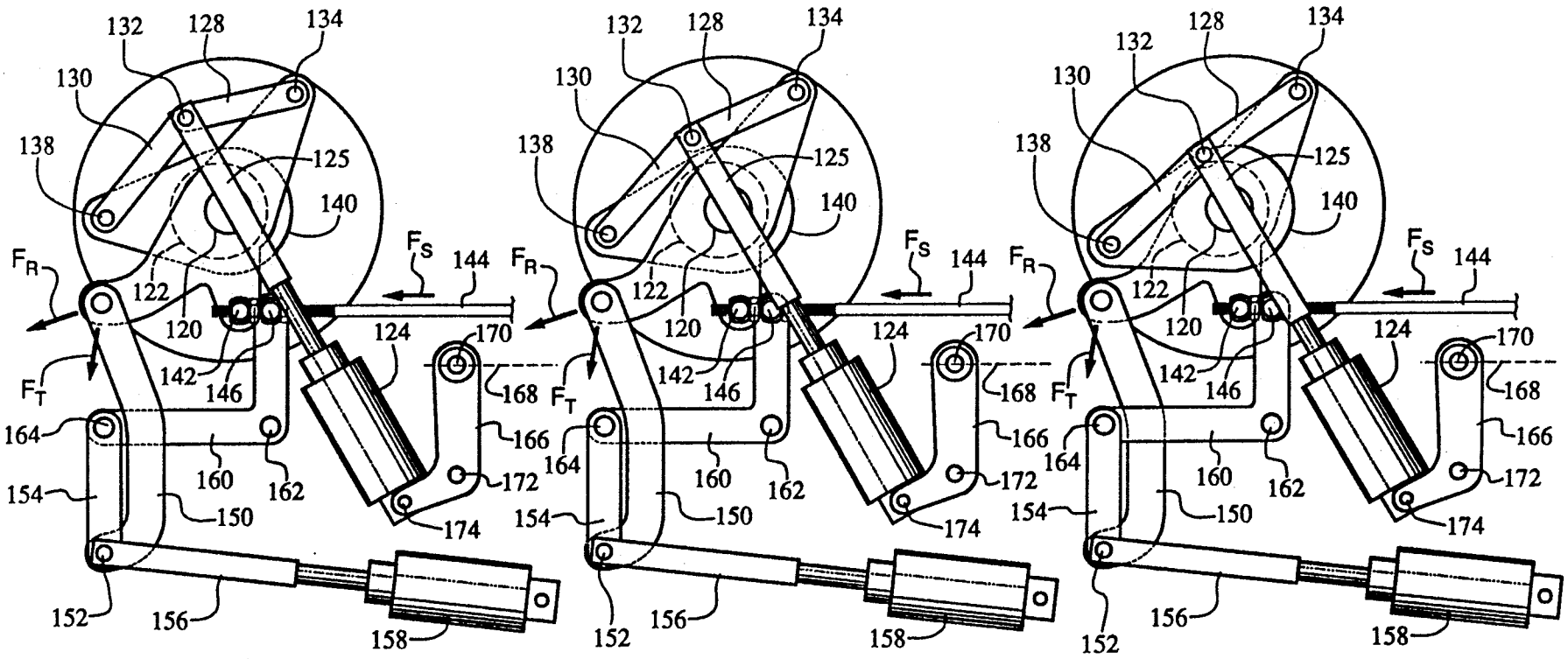
FIGS. 8A, 8B and 8C are end views of a third embodiment of an offset printing machine in which the first air cylinder for moving the lever driving the eccentric shaft is held constant while the second air cylinder driving the lever coupled to the eccentric tube member is moved through three different positions to illustrate the operation of the device.

FIGS. 8A, B and C illustrate a second embodiment of the present invention. In FIG. 8A, a control link 136 has three spaced pivot points 134, 142 and 148 that form a scalene triangle and acts as a first arm that is attached to the eccentric shaft 120 substantially in the center of the control link 136. A teardrop shaped lever 140 acts as a second arm and is attached to the eccentric tube member 140 at substantially the center of the large portion of the teardrop shape. A first link 130 is pivotally attached at one end 138 to the small end of the teardrop shaped lever 140. A second link 128 is pivotally attached at one end to the pivot point 134 of the triangular spaced pivot points of control link 136. A first air cylinder 124 with a piston 125 is pivotally coupled to the other end of both the first and second links 128 and 130 at 132 such that movement of the air cylinder piston 125 moves the eccentric tube 122 and the eccentric shaft 120 in unison and in opposite directions.

A second air cylinder 158 with a piston 156 is coupled at the outer end 152 by a link 150 to a second one of the triangular spaced pivots 148 of the control link 136 for rotating the eccentric shaft 120 to cause blanket cylinder/impression cylinder throw-off without movement of the eccentric tube member 122. A fourth pivotable link 166 having one end 174 pivotally coupled to the other end of the first air cylinder 124 has a first adjustable length rod 168 coupled to the other end 170 thereof, such as by threads, so that by adjusting the first rod 168, the first air cylinder 124 moves to change the blanket/plate contact separation. A fifth over center toggle link 154 has one end connected to the outer end 152 of the second air cylinder piston 156. A sixth L-shaped link 160 is pivotally mounted on a frame wall 121 substantially at the center 162 of the junction of the legs of the L-shaped link 160 with one end 164 of one leg of the sixth link 160 being pivotally attached to the other end of the fifth over center toggle 154 such that the counterclockwise force vector applied to the control link 136 and eccentric shaft 120 by the second air cylinder 158 passes through the other end 164 of the fifth over center toggle 154. A second adjustable length rod 144 has one end threadedly coupled to the outer end 146 of the other leg of the sixth L-shaped link 160 and to the third pivot point 142 of the control link 136 to provide an adjustable stop such that both the control link 136 rotatable position and the fifth over center toggle 154 are adjusted simultaneously. Thus, as can be seen in FIG. 8A, a toggle linking force, $F_T$, produced by the third toggle link 150 locking over the one end 164 of the fifth over center toggle linkage 154 produces a counterclockwise movement about the eccentric shaft 120 which is opposed by the adjustable stop, $F_S$, which generates a vector resultant sum, $F_R$. The force $F_R$ is generally colinear with the resultant of the two vectors produced by the plate and impression cylinder pressures acting on the blanket cylinder. FIGS. 8B and C show other positions of the printing machine elements as the first air cylinder 124 moves its piston 125 and piston 156 of second air cylinder 158 is held constant.

Figure 9C:
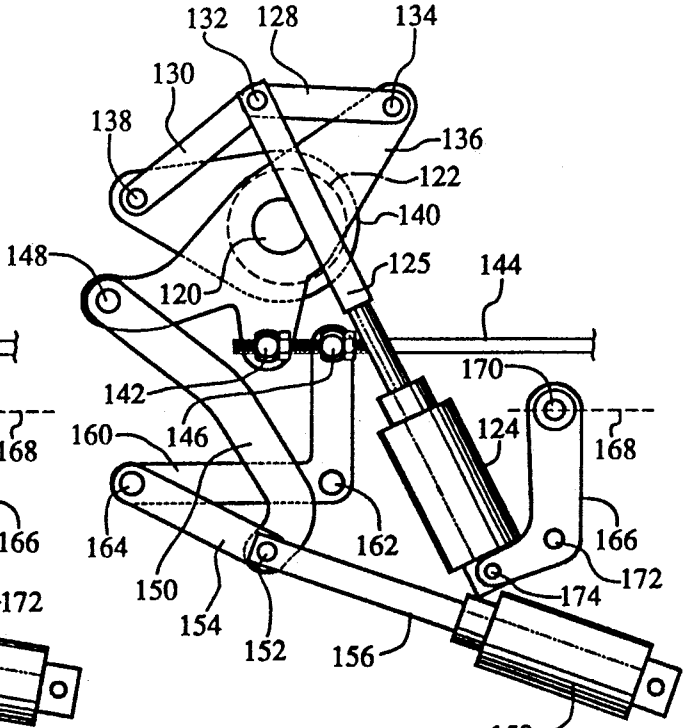
FIGS. 9A, 9B and 9C are end views of the device illustrated in FIG. 8 wherein the second air cylinder coupled to the eccentric tube member is held constant and the first air cylinder coupled to the lever driving the eccentric shaft is illustrated in three different positions.
Figure 9B:
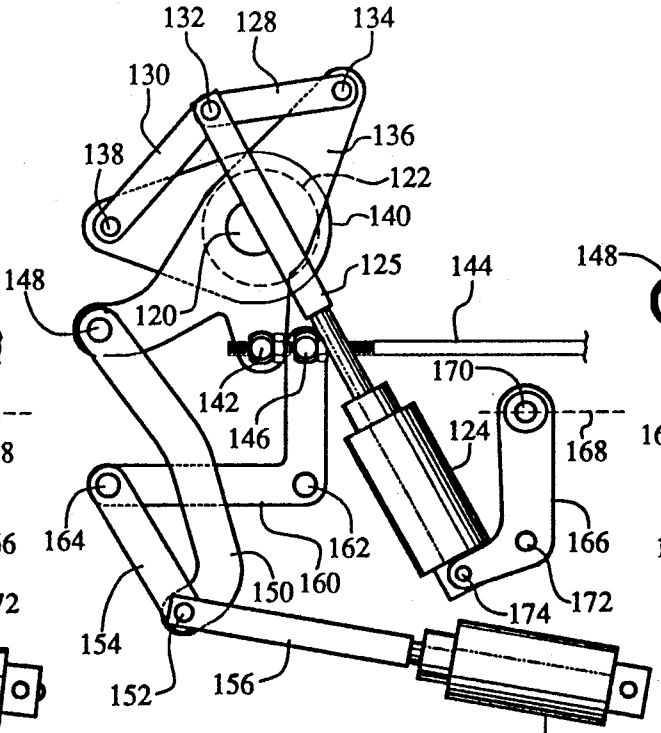
Figure 9A:
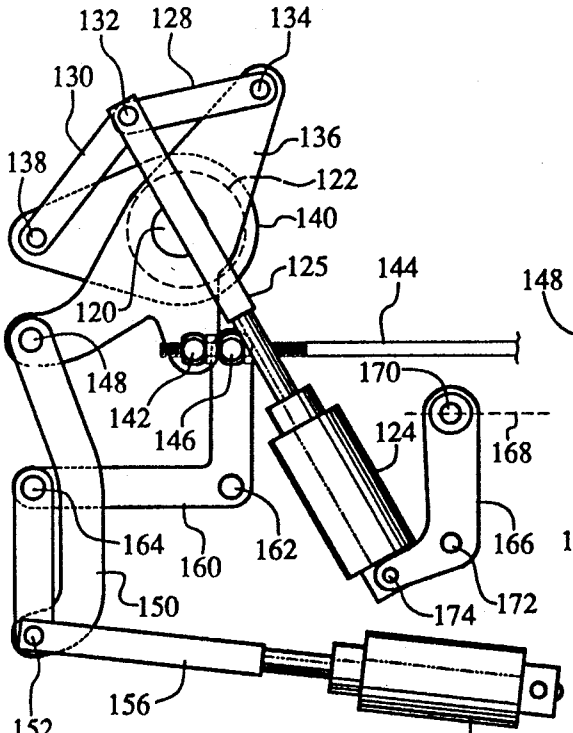

FIGS. 9A, B and C illustrate piston 125 of first air cylinder 124 being held constant and illustrating the three positions of the control link 136 as the link is moved by second air cylinder 158.

Figure 10:
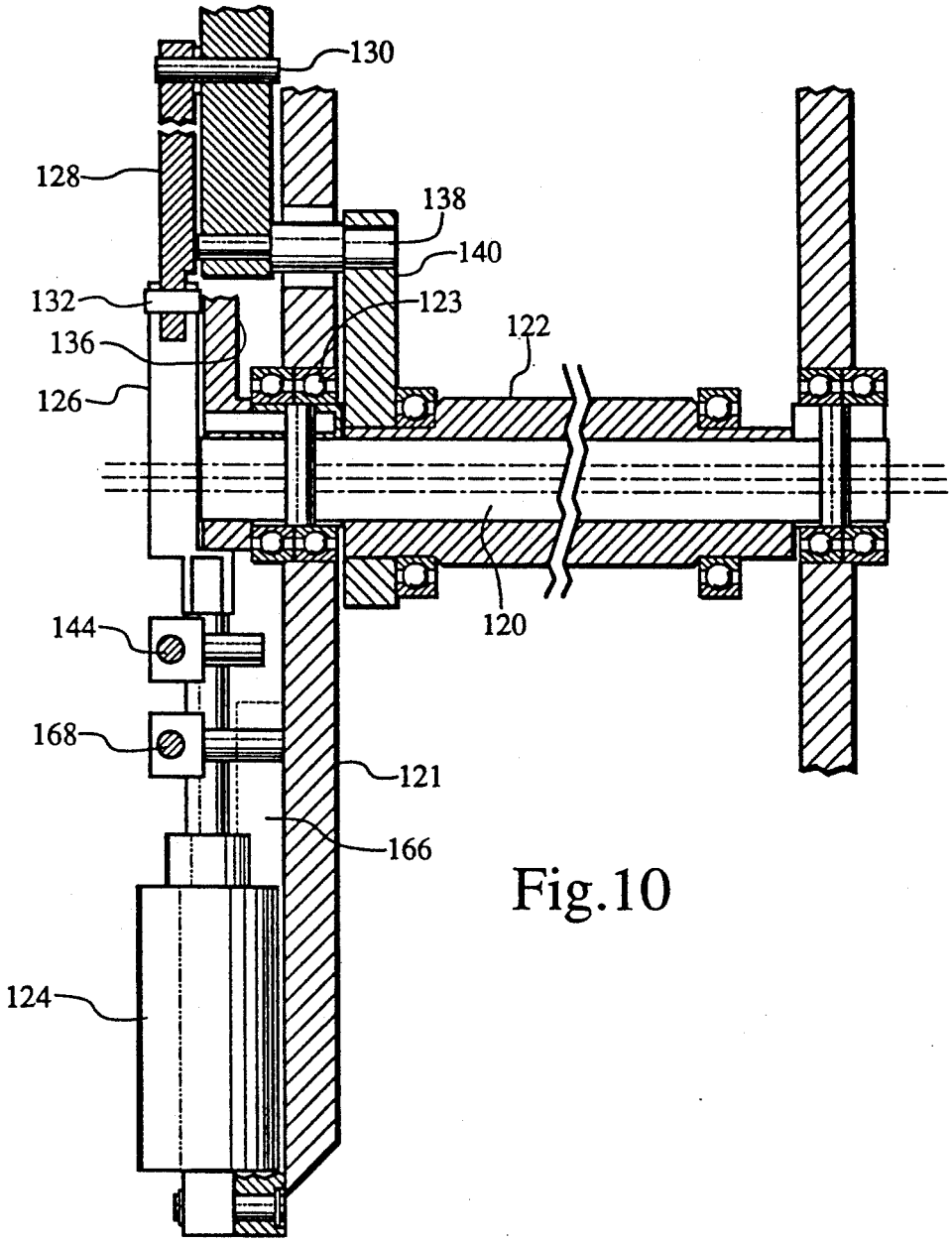
FIG. 10 is a partial cross-sectional view of the mechanism illustrated in FIGS. 8 and 9.

FIG. 10 is a partial cross-sectional view illustrating the elements of the mechanism shown in FIGS. 8 and 9.

Thus, there has been disclosed a novel impression throw-off apparatus which consists of an eccentric shaft supported on both the drive and operator sides of the machine by an eccentric tube. The eccentric shaft is mounted within the eccentric tube and the eccentric outside diameter of the tube supports the blanket cylinder bearings and provides adjustment for plate thickness. Force from an air cylinder acts through linkages to produce a force on the eccentric tube which is in the same general direction as the impression forces. A curved stop arm acting in concert with an eccentric roller limits the travel of the linkage and thus the relative rotary position of the eccentric tube with respect to the eccentric shaft. This provides for operator adjustment while at the same time providing additional force to supplement that of the air cylinder to provide an external force that prevents motion of the shaft within the eccentric tube. The eccentric roller is adjustable for changes in blanket thickness and is controlled as set forth in commonly assigned co-pending application Ser. No. 575,034, filed Aug. 30, 1990. If desired, the curved stop arm may be repeated on the drive side to act as an additional stabilizing influence. Preferably, it is deleted from the operator's side and appears only on the drive side of the machine to provide the external force on each side.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any other known element having the equivalent function.

I claim:

1. An offset printing machine comprising:

laterally spaced vertical frame side walls;

a fixed master cylinder rotatably mounted between the walls for carrying a transferable image thereon;

a fixed impression cylinder rotatably mounted between the walls for carrying paper thereon to receive the image;

an eccentric shaft rotatably mounted between the walls for movement about a first pivot point;

an eccentric tube member rotatably mounted on the shaft for movement about a second pivot point; and a blanket cylinder rotatably mounted on the eccentric tube member such that rotation of the eccentric tube member about the second pivot point causes a predetermined pressure contact of the blanket cylinder with the master cylinder for receiving the image from the master cylinder and rotation of the shaft about the first pivot point causes a variation in the pressure contact of the blanket cylinder with the impression cylinder to transfer the image to the paper.

2. An offset printing machine as in claim 1 further comprising means coupled to the blanket cylinder for independently and selectively adjusting the first and second pivot points so as to maintain a first predetermined desired contact pressure between the blanket cylinder and the master cylinder and to maintain a second predetermined contact pressure between the blanket cylinder and the impression cylinder.

3. An offset printing machine as in claim 1 further comprising:

linkage means coupled to only one end of the eccentric tube for rotating the eccentric tube to position the blanket cylinder towards and away from the master cylinder; and an adjustable stop mechanism associated with the adjustment of the eccentric tube for allowing the blanket cylinder to move toward the master cylinder only a predetermined amount so as to maintain the predetermined pressure with the master cylinder.

4. An offset printing machine as in claim 3 further comprising a stop arm formed as a curved extension attached to the linkage means for rotating the eccentric tube such that rotation of the eccentric tube moves the curved extension toward and away from the adjustable stop mechanism thereby controlling the contact pressure of the blanket cylinder with the master cylinder.

5. An offset printing machine as in claim 4 wherein the stop mechanism is an eccentric cam which, when rotated, moves toward and away from the curved extension to provide an adjustable stop.

6. An offset printing machine as in claim 5 further comprising:

a curved extension coupled to the eccentric tube adjacent to each of the laterally space side walls; and one of the eccentric cams positioned adjacent to each curved extension for providing an adjustable stop adjacent to each of the laterally spaced side walls.

7. An offset printing machine as in claim 6 wherein:

the curved extension is substantially concentric with the rotatable mounting of the eccentric shaft throughout the range of blanket-cylinder-to-plate-cylinder adjustment so that rotation of the blanket cylinder into and out of contact with the impression cylinder does not cause significant relative motion between the eccentric shaft and the eccentric tube; and the adjustment between the blanket cylinder and the impression cylinder will have an insignificant effect on the blanket-to-plate cylinder adjustment thereby providing ease of operation.

8. An offset printing machine as in claim 1 further comprising:

bearings mounted on each end of the eccentric tube; and said blanket cylinder being rotatably mounted on the bearings.

9. An offset printing machine as in claim 1 further comprising means for sequentially rotating the eccentric tubular member and the eccentric shaft in two steps to set the blanket cylinder into pressure engagement initially with the master cylinder for receiving an image and subsequently with the impression cylinder to transfer the image to paper.

10. An offset printing machine as in claim 3 wherein said means for rotating the eccentric tube about the first pivot point further comprises:

a first toggle lever rotatably coupled to only one end of the eccentric tube;

a first air cylinder coupled to one end of the first toggle lever for pivoting the first toggle lever between first and second positions; and a linkage having one end coupled to the eccentric tube and the other coupled to the first toggle lever such that movement of the first toggle lever between the first and second positions rotates the eccentric tube to move the blanket cylinder eccentrically into and out of engagement with the master cylinder.

11. An offset printing machine comprising:

laterally spaced vertical frame side walls;

a fixed master cylinder rotatably mounted to and between the walls for carrying a transferable image thereon;

a fixed impression cylinder rotatably mounted to and between the walls for carrying paper thereon for receiving the image;

a blanket cylinder rotatably mounted between the walls for a first eccentric movement about a first pivot point to make pressure contact with the master cylinder for receiving the image and for subsequent second eccentric movement about a second pivot point for making pressure contact with the impression cylinder to transfer the image to the paper;

an eccentric tube supporting the rotatable blanket cylinder, said tube mounted between the walls for rotation about the first pivot point to cause the first eccentric movement of the rotatable blanket cylinder;

first toggle means coupled to only one end of the eccentric tube for independently and selectively rotating the tube about the first pivot point with a force represented by a first force vector to cause the first eccentric movement of the blanket cylinder and provide a predetermined pressure contact between the blanket cylinder and the master cylinder as represented by a second force vector;

a shaft eccentrically mounted within the eccentric tube and to and between the spaced side walls for rotation about the second pivot point to cause the second eccentric movement of the blanket cylinder;

second toggle means coupled to the eccentrically mounted shaft for independently and selectively rotating the shaft about the second pivot point to cause the second eccentric movement of the blanket cylinder and provide a predetermined pressure contact between the blanket cylinder and the impression cylinder as represented by a third force vector; and a stop arm associated with the eccentric tube for limiting rotation of the tube about the first pivot point and generating a fourth force vector, the fourth force vector being applied in substantially the same direction as the first force vector, thereby tending to maintain a desired contact pressure between the blanket cylinder and master cylinder and between the blanket cylinder and the impression cylinder when the impression forces are removed.

12. An offset printing machine comprising:

laterally spaced vertical frame side walls;

a fixed master cylinder rotatably mounted between the walls for carrying a transferable image thereon;

a fixed impression cylinder rotatably mounted between the walls for carrying paper thereon to receive the image;

an eccentric shaft rotatably mounted between the walls for movement about a first pivot point;

an eccentric tube member rotatably mounted on the shaft for movement about a second pivot point; and a blanket cylinder rotatably mounted on the eccentric tube member such that rotation of the eccentric tube member about the second pivot point causes a predetermined distance relationship between the blanket cylinder and the impression cylinder to transfer the image to the paper and rotation of the shaft about the first pivot point causes a predetermined distance relationship between the blanket cylinder and the master cylinder for receiving the image from the master cylinder.

13. An offset printing machine comprising:

laterally spaced vertical frame side walls;

a fixed master cylinder rotatably mounted between the walls for carrying a transferable image thereon;

a fixed impression cylinder rotatably mounted between the walls for carrying paper thereon to receive the image;

an eccentric shaft rotatably mounted between the walls for movement about a first pivot point;

an eccentric tube member rotatably mounted on the shaft for movement about a second pivot point;

a blanket cylinder rotatably mounted on the eccentric tube member for cooperating with said master cylinder and said impression cylinder to transfer an image from the master cylinder to the impression cylinder; and linkages coupling said eccentric shaft and said eccentric tube to said blanket cylinder for producing an eccentric supported on an eccentric to provide independent and sequential adjustment to and throw-offs for the blanket cylinder with respect to both the master cylinder and the impression cylinder.

14. An offset printing machine as in claim 13 further including:

a first linkage coupled to the eccentric tube for varying the position of the blanket cylinder with respect to the master cylinder; and a second linkage coupled to the eccentric shaft for varying the position of the blanket cylinder with respect to the impression cylinder.

15. An offset printing machine as in claim 13 further including:

a first linkage coupled to the eccentric tube for varying the position of the blanket cylinder with respect to the impression cylinder; and a second linkage coupled to the eccentric shaft for varying the position of the blanket cylinder with respect to the master cylinder.

16. An offset printing machine comprising:

laterally spaced vertical frame side walls;

a first master cylinder containing an image to be copied and a second impression cylinder rotatably mounted between said walls for carrying paper to receive the image;

an eccentric shaft mounted between said walls and rotatable about a shaft pivot point;

an eccentric tube member mounted on said eccentric shaft for rotation about a tube pivot point to form an eccentric supported on an eccentric;

a third blanket cylinder rotatably mounted on said eccentric tube member; and linkage means separately coupled to each eccentric to cause the rotatable blanket cylinder to first engage the image on the master cylinder to receive the image and subsequently to cooperate with the impression cylinder to transfer the image to the impression cylinder paper.

17. A offset printing machine as in claim 16 wherein said linkage means comprises:

a first arm coupled to said eccentric shaft for rotating the shaft and causing the third blanket cylinder to move toward and away from one of said first and second cylinders; and a second arm coupled to said eccentric tube member for causing the blanket cylinder to move toward and away from the other one of said first and second cylinders to cause a transfer of said image on said master cylinder to said impression cylinder paper.

18. An offset printing machine as in claim 17 wherein:

movement of said second arm causes said third blanket cylinder to move into pressure contact with said first master cylinder to receive said image; and movement of said first arm causes said third blanket cylinder to move subsequently into pressure contact with said second impression cylinder to transfer said image to said paper.

19. An offset printing machine as in claim 17 further including:

an L-shaped lever as said first arm which is pivotally attached to said shaft at a point substantially at the junction of the legs of the L-shaped lever for rotating said shaft;

a teardrop shaped lever as said second arm and attached to said eccentric tube member at substantially the center cf the large portion of the teardrop shaped lever;

a triangular link with three triangular spaced pivot points, a first pivot point being coupled to the outer end of a short leg of said L-shaped member;

an elongated link coupling a small end of said teardrop shaped lever and a second pivot point of said triangular link; and a first power driven cylinder having a movable piston coupled at the outer end thereof to the third pivot point of said triangular link for moving said blanket cylinder into and out of pressure contact with said master cylinder to receive said image, said third pivot point moving in an arc that includes superimposed position with the eccentric shaft pivot point.

20. An offset printing machine as in claim 19 further including:

a pivotable link coupled at one end to the outer end of said first power driven cylinder;

a first rod adjustably coupled to the other end of said pivotable link such that adjusting said first rod with respect to said pivotable link moves the piston of said cylinder to rotate the eccentric tube member-to adjust the blanket-to-plate engagement as needed to properly receive the image; and a second rod adjustably coupled to the long leg of the L-shaped member at a point such that during movement of said L-shaped member, said second rod coupling point is along a line perpendicular to the second rod and which passes through said eccentric shaft pivot point such that adjusting said second rod with respect to said L-shaped member rotates said eccentric shaft to adjust the blanket-to-impression cylinder engagement as needed to properly transfer the image to the paper on the impression cylinder.

21. An offset printing machine as in claim 20 and further including a second power driven cylinder having a piston coupled to the outer end of a long leg of said L-shaped member for moving said third blanket cylinder into and out of pressure contact with said second impression cylinder to transfer said image to said second impression cylinder paper, said triangular link enabling adjustment of said pressure contact between said blanket cylinder and said impression cylinder substantially without changing the eccentric tube member adjustment and enabling both the eccentric tube and eccentric shaft to move in unison during adjustment of said pressure contact between said blanket cylinder and said impression cylinder.

22. An offset printing machine as in claim 17 further including:

a control link with three triangular spaced pivot points as said first arm, said control link being attached to said eccentric shaft substantially in the center thereof;

a teardrop shaped lever as said second arm, said teardrop shaped lever being attached to said eccentric tube member at substantially the center of the large portion of the teardrop shape;

a first link pivotally attached at one end to the small end of the teardrop shaped lever;

a second link pivotally attached at one end to one of the triangular spaced pivot points of the control link;

a first air cylinder with a piston pivotally coupled to the other end of both the first and second links such that movement of the air cylinder piston moves the eccentric tube and the eccentric shaft in unison and in opposite directions;

a second air cylinder with a piston; and a third linkage coupled between a second one of the triangular spaced pivots of the control link and the second air cylinder piston for rotating said eccentric shaft to cause blanket cylinder/impression cylinder throw-off without movement of said eccentric tube member.

23. An offset printing machine as in claim 22 further including:

a fourth pivotable link having one end pivotally coupled to the other end of said first air cylinder; and a first adjustable length rod coupled to the other end of said fourth link such that by adjusting said first rod, said first air cylinder moves to change the blanket/master contact separation.

24. An offset printing machine as in claim 23 further including:

a fifth over center toggle length having one end connected to the outer end of the second air cylinder piston;

a sixth L-shaped link pivotally mounted to a frame wall at substantially the center of said sixth L-shaped link with one end of one leg of the sixth link pivotally attached to the other end of said fifth over center toggle such that the counterclockwise force vector applied to the control link and eccentric shaft by said second air cylinder passes through said other end of said fifth over center toggle; and a second adjustable length rod having one end threadedly coupled to the outer end of the other leg of said sixth L-shaped link and to the third pivot point of said control link to provide an adjustable stop such that both the control link rotatable position and the fifth over center toggle are adjusted simultaneously.

25. A offset printing machine as in claim 24 wherein a toggle linking force, $F_T$, produced by said third toggle link locking over said one end of said fifth over center toggle linkages produces a counterclockwise movement about the eccentric shaft which is opposed by adjustable stop, $F_S$, generating a vector resultant sum, $F_R$, which is generally colinear with the resultant of the two vectors produced by the plate and impression cylinder pressures acting on the blanket cylinder.

* * * * *